US007070477B2

(12) United States Patent
Morisawa et al.

(10) Patent No.: US 7,070,477 B2
(45) Date of Patent: Jul. 4, 2006

(54) METHOD OF POLISHING SEMICONDUCTOR WAFER

(75) Inventors: Toshihiro Morisawa, Yokohama (JP); Hisahiko Abe, Tokyo (JP); Kosaku Tachikawa, Hitachinaka (JP); Toshihiro Nakajima, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/117,294

(22) Filed: Apr. 29, 2005

(65) Prior Publication Data

US 2005/0245169 A1 Nov. 3, 2005

(30) Foreign Application Priority Data

Apr. 30, 2004 (JP) ..... 2004-136298

(51) Int. Cl.
*B24B 49/00* (2006.01)

(52) U.S. Cl. ..... 451/5; 451/41

(58) Field of Classification Search ..... 451/5, 451/8, 28, 41; 438/691–693
See application file for complete search history.

(56) References Cited

U.S. PATENT DOCUMENTS 6,213,848 B1 * 4/2001 Campbell et al. ..... 451/41
6,524,163 B1 * 2/2003 Stirton ..... 451/5
6,620,726 B1 * 9/2003 Preusse et al. ..... 438/633
6,932,671 B1 * 8/2005 Korovin et al. ..... 451/5
6,949,007 B1 * 9/2005 Wang et al. ..... 451/5
2001/0000773 A1 * 5/2001 Campbell et al. ..... 451/41
2005/0032459 A1 * 2/2005 Surana et al. ..... 451/5

FOREIGN PATENT DOCUMENTS

| | | |
|---|---|---|
| JP | 09-323261 | 12/1997 |
| JP | 11-019864 | 1/1999 |
| JP | 11-061454 | 3/1999 |
| JP | 2002-043300 | 2/2002 |
| JP | 2002-124497 | 4/2002 |
| JP | 2002-184733 | 6/2002 |

* cited by examiner

*Primary Examiner*—Dung Van Nguyen
(74) *Attorney, Agent, or Firm*—Antonelli, Terry, Stout and Kraus, LLP.

(57) ABSTRACT

In a wafer polishing method, a within-wafer distribution model of a removal rate and a within-wafer distribution model of a polishing process are selected, and a within-wafer distribution of a removal rate is obtained by determining parameters of a within-wafer distribution model of a removal rate based on the within-wafer distribution of the film thickness before/after CMP, polishing condition data, and the selected within-wafer distribution model of the polishing process of the polished wafer. Then, a film thickness in the polishing process is estimated from passage of time based on the obtained within-wafer distribution of the removal rate, the selected within-wafer distribution model of the polishing process, and the film thickness before CMP of the wafer to be processed, thereby determining the polishing conditions with a restriction that the film thickness at each position in the within-wafer distribution of the film thickness after CMP satisfies the control limit.

8 Claims, 13 Drawing Sheets

DISTRIBUTION MODEL OF VALUES IN EACH RADIAL SECTION

DETERMINATION OF RADIAL DISTRIBUTION (STRAIGHT LINE) FROM MEASUREMENT RESULT OF FILM THICKNESS

MEASUREMENT SITES ARRANGED
ON THE SAME RADIAL CIRCUMFERENCE

FILM THICKNESS BEFORE/AFTER CMP
OF MONITOR WAFER

FILM THICKNESS BEFORE/AFTER CMP OF PRODUCT WAFER

WITHIN-WAFER DISTRIBUTION OF REMOVAL RATE

DEPOSITION OF OXIDE FILM ON METAL WIRING

DETERMINATION OF POLISHING TIME IN WHICH MARGIN OF FILM THICKNESS AFTER CMP FROM UPPER CONTROL LIMIT AND LOWER CONTROL LIMIT BECOMES LARGEST

TREND OF FILM THICKNESS AFTER CMP OF EACH PRODUCT WAFER ACCORDING TO PAST RESULT

DETERMINATION WHETHER OR NOT PROCESS IS STARTED IN WHICH WITHIN-WAFER DISTRIBUTION OF FILM THICKNESS AFTER CMP IS REFLECTED

METHOD OF POLISHING SEMICONDUCTOR WAFER

CROSS-REFERENCE TO RELATED APPLICATION

The present application claims priority from Japanese Patent Application JP 2004-136298 filed on Apr. 30, 2004, the content of which is hereby incorporated by reference into this application.

TECHNICAL FIELD OF THE INVENTION

The present invention relates to a wafer polishing technology, and in particular to a technology effectively applied to a method for determining polishing conditions in a recipe setting or a recipe correction of the equipment for polishing (chemical mechanical polishing: CMP) a wafer which constitutes a thin film product such as a semiconductor device or the like. More specifically, the technology includes a recipe determining method which can bring the within-wafer distribution of a film thickness after CMP within a control limit with a lot of margin in the case of wafer processing, and a wafer fabricating method which determines whether the fabrication process of at least one or more wafers at the same time and in batch processing is started or not by comparing the variation in film thickness after CMP and the margin with respect to the control limit of the within-wafer distribution in each wafer to be processed.

BACKGROUND OF THE INVENTION

Conventionally, in the process for polishing a product wafer, after attaching a pad, a polishing head, and a grid (dresser), the QC of the polishing equipment is performed to monitor the various status quantities such as a removal rate and uniformity thereof, and then, it is determined whether or not the polishing equipment can be used in the fabrication process. When starting the process of the product wafer, the film thickness prior to the polishing is measured. Alternatively, assuming that the film thickness prior to the polishing is set in a control limit, the polishing condition is determined so that the film thickness after CMP satisfies the control limit, and the parameters of the recipe is determined for each type of the product wafer and process (set for each layer of the films to be polished). Then, the process is started.

After a plurality of product wafers are processed, the state of the polishing equipment which has been used in the process is changed with the passage of time due to the load at the time of polishing, and the removal rate in the wafer surface becomes different from that at the time of the QC of the equipment. As a result, there arises a problem that the film thickness after CMP does not satisfy the control limit in the recipe determined based on the removal rate monitored in the QC of the equipment.

Furthermore, the film thickness before the polishing of the product wafer or the surface profile of the wafer depends on the state of various types of equipment, a device shape/pattern, and a wiring shape/pattern in the process flow through which the wafer has been processed. Therefore, due to the difference in thickness and surface profile of the various types of product wafers before the polishing, it is necessary to determine the polishing condition in accordance with the types of the films and structures in order to set the film thickness after CMP to a predetermined thickness.

As a consequence, the run-to-run method has been devised, in which the recipe is adjusted by estimating the removal rate based on the thickness before/after CMP of the product wafer which has been already processed and the polishing conditions and estimating the wafer condition determined by the process flow.

For example, Japanese Patent Application Laid-Open No. 2002-124497 discloses the method in which the film thickness before/after CMP of the product wafer and the polishing conditions are compared with the film thickness before/after CMP of the wafer serving as a reference and the polishing conditions so that the polishing time and the polishing pressure are fed back to the subsequent process.

Furthermore, the removal rate is changed in a different manner at respective portions of the distribution within the range of the wafer surface, and an influence on the change in the film thickness after CMP due to the difference in the film thickness before CMP and in the surface profile resulting from the process flow before polishing the product wafer also differs at respective portions of the surface. As a consequence, the polishing conditions determined by the within-wafer distribution of the removal rate obtained in the QC of the equipment and the polishing conditions determined by the within-wafer distribution of the film thickness before CMP and the surface profile set for the product and process cannot assure that the film thickness after CMP at each portions in the wafer surface satisfies the control limit.

Therefore, a method for improving the removal rate of the polishing equipment and the uniformity in the wafer surface of the equipment performance of other equipment in the various processes has been suggested. Furthermore, a method for adjusting the within-wafer distribution of the processing capability in the latter process in order to cancel the within-wafer distribution of the status quantity of the processed product wafer generated in a certain process has been suggested.

For example, the wafer polishing equipment and the method for fabricating a semiconductor device using the wafer polishing equipment described in Japanese Patent Application Laid-Open No. 9-323261 has suggested the method for the CMP in which the discharge amount of the polishing agent (slurry) to a polishing cloth (pad) is adjusted so as to make the wafer state after CMP uniform.

Also, the polishing equipment described in Japanese Patent Application Laid-Open No. 11-19864 has described the method for the CMP in which the within-wafer distribution of the removal rate (processing capability) is adjusted at the time of the polishing based on the distribution of the film thickness of the wafer before CMP, thereby making the film thickness after CMP uniform.

The processing method, the measurement method, and the method for fabricating a semiconductor device which are described in Japanese Patent Application Laid-Open No. 2002-184733 have described the method in which a correlation function of a status quantity at each within-wafer portion is obtained based on the distribution data in the wafer surface between a plurality of wafers or between a plurality of processes of the same wafer, and the process conditions for minimizing the uniformity in the wafer surface are obtained by using the correlation function.

The dry etching equipment of an aluminum film and an aluminum alloy film, the dry etching method, the apparatus for fabricating a semiconductor device, the method for fabricating a semiconductor device and the semiconductor device described in Japanese Patent Application Laid-Open No. 11-61454 have described the method for the dry etching for etching an aluminum film, in which a gas flow rate at the etching time is adjusted, thereby improving the uniformity of an etching rate in the wafer surface.

The method for determining a control condition of the thermal treatment equipment, thermal treatment equipment, and a thermal treatment method described in Japanese Patent Application Laid-Open No. 2002-43300 have described the method for eliminating the nonuniformity in the thickness of an oxide film in the wafer surface generated by the thermal treatment process, in which a rate of the film formation amount with respect to a temperature is obtained as the within-wafer distribution based on the within-wafer distribution of the film thickness, and the temperature distribution in the wafer surface is determined so as to make the film thickness uniform.

SUMMARY OF THE INVENTION

However, the wafer polishing equipment and the method for fabricating a semiconductor using the wafer polishing equipment described in Japanese Patent Application Laid-Open No. 9-323261 and the polishing equipment described in Japanese Patent Application Laid-Open No. 11-19864 have described the method for making the removal rate and the film thickness after CMP uniform, but the evaluation of the control limit of the film thickness after CMP which determines whether or not the process of the product wafer is finished is not considered. Therefore, there is a possibility that the deviation from the control limit of the film thickness after CMP occurs. Japanese Patent Application Laid-Open No. 9-323261 and No. 11-19864 do not describe a method for determining the process condition which reflects the control limit.

The processing method, the measuring method and the method for fabricating the semiconductor device which are described in Japanese Patent Application Laid-Open No. 2002-184733 have described the method in which a correlation function of a status quantity between a plurality of wafers or between a plurality of processes of the same wafer is obtained, and the process conditions for making within-wafer distribution after the process uniform is obtained by using the correlation function. However, it is impossible to determine the process condition capable of preventing the processed quantity after processing from deviating from the control limit obtained when starting the process.

In the dry etching equipment of an aluminum film and an aluminum alloy film, the dry etching method, the method for fabricating a semiconductor device, and the semiconductor device described in Japanese Patent Application Laid-Open No. 11-61454, although it is thought in general that the etching rate is different depending on the type of the LSI chip arranged on the wafer, since the within-wafer distribution of the etching rate cannot be estimated on the basis of the difference. Therefore, the process state after etching cannot be estimated at the time of starting the process for the product, and thus, it is impossible to determine the process condition capable of bringing the wafer condition after etching within the control limit.

Also in the method for determining the control condition of the thermal treatment equipment, the thermal treatment equipment and the method for the thermal treatment described in Japanese Patent Application Laid-Open No. 2002-4330, the method for determining a condition for forming an uniform film in a plane by controlling the film formation amount in the surface. However, the method is not a method in which the process condition is determined with using the control limit as a restrictive condition.

Furthermore, in any of Japanese Patent Application Laid-Open No. 9-323261, 11-19864, 2002-184733, 11-61451, 2002-43300, and 2002-124497, it is impossible to determine the start of the process for the product wafer by estimating the within-wafer distribution of the wafer in the state after the processing with respect to the control limit.

Then, the inventors of the present invention notices the problems of the conventional technology described above and provide the invention capable of attaining the objects described below.

First, an object of the present invention is to make it possible to determine the processing capability distribution at the time of starting the process and to accurately estimate the within-wafer distribution of the removal rate in the polishing equipment at the time of starting the process for a product wafer by polishing a monitor wafer or acquiring the past process result in order to monitor the removal rate of the polishing equipment and estimating the parameters (coefficient) of the within-wafer distribution model of the polishing process and the within-wafer distribution model of the film thickness before/after CMP to determine the within-wafer distribution of the removal rate.

Furthermore, another object of the present invention is to make it possible to represent the polishing process which depends on the time passage and the process condition and to accurately estimate the film thickness after CMP on the basis of the within-wafer distribution of the removal rate regardless of the type of the object product and the process by preparing the polishing process as a model.

In addition, another object of the present invention is to determine the polishing condition capable of acquiring a predetermined film thickness after CMP with respect to the control limit by making it possible to estimate the removal rate even with the passage of time and under variable polishing conditions and determine the condition which enables a film thickness after CMP to satisfy the restrictive condition with respect to the control limit based on the state before CMP of the product wafer to be processed.

Furthermore, still another object of the present invention is to prevent the failure of the process by determining whether or not the process can be started depending on the probability of the occurrence of the process failure after polishing by estimating a variation in each lot of the product wafer lot and each wafer based on the actual result of the process of the past product at the time of starting the process and by comparing the variation and the margin of the film thickness after CMP in the wafer surface with respect to the control limit in the case of the process started under the determined polishing condition.

In order to attain the objects described above, the polishing equipment and the film thickness measurement equipment according to the present invention are connected to a system for determining a polishing condition via a controller for directly controlling the equipment or an equipment group control system. The determined polishing condition is instructed as a process execution content of the equipment to each of the polishing equipment and the test equipment at the timing of starting the process of the product wafer.

The means for accumulating the processing content in the form of the polishing condition data and the film thickness data before CMP and the film thickness data after CMP is provided in the case where the polishing and the film thickness measurement are performed. Furthermore, the means for associating the polishing data and the data of the film thickness before/after CMP with each of the wafers in lots is provided and, in particular, the means for associating the film thickness data before/after CMP with each measurement site in the wafer surface is provided.

Since the present invention is provided with a function to obtain the within-wafer distribution of model parameter in the polishing process by determining the data of the polishing condition for each wafer based on the polishing result of the monitor wafer in the QC of the equipment or the polishing result of the product wafer and determining a parameter of the within-wafer distribution model of the film thickness before/after CMP which is defined for each of the polishing processes based on the data of the film thickness before/after CMP which is calculated for each of the measurement positions and provided with a function to obtain the within-wafer distribution of the removal rate by determining a parameter of the within-wafer distribution model of the removal rate based on the within-wafer distribution model in the polishing process, it is possible to evaluate and acquire the change in the removal rate.

Also, since the present invention is provided with a function to obtain the within-wafer distribution of the film thickness before CMP by determining a parameter of the within-wafer distribution model of the film thickness before CMP based on the film thickness before CMP which is acquired for each of the measurement positions of the product wafer to be processed and to estimate the distribution of the film thickness in the polishing process based on the obtained within-wafer distribution of the film thickness before CMP and the within-wafer distribution of removal rate and the within-wafer distribution model of the polishing process and a function to obtain a polishing condition by adjusting a variable parameter of the within-wafer distribution model of the removal rate or the within-wafer distribution model of the polishing process under the predetermined restrictive condition with respect to the control limit of the film thickness after CMP, it is possible to determine the polishing condition which can make the film thickness within the wafer after CMP uniform.

Alternatively, it is possible to determine the polishing condition in which the within-wafer distribution of the film thickness after CMP which depends on the removal rate, the film thickness before CMP and the within-wafer distribution of the polishing process can be completely brought within the control limit with an equal interval from the upper limit and the lower limit thereof.

Furthermore, since the present invention is provided with a function to estimate the variation in the film thickness after CMP between wafers or between lots based on the result of the polishing of the product wafers to be processed and the past process start in the same product and the same process or to estimate the variation in the film thickness after CMP based on the variation in the film thickness before CMP, the variation in the removal rate and the variation in the parameters of the polishing process model and a function to determine a probability of the deviation of a maximum value or a minimum value of the film thickness after CMP from the upper control limit or the lower control limit by comparing the margin with respect to the control limit of the within-wafer distribution of the film thickness after CMP with the variation in the film thickness after CMP, it is possible to predict the occurrence of failures at the time of starting the process, determine whether or not the process can be started, and prevent the failure of the process.

More specifically, the present invention is applied to the method for polishing a wafer having the following steps.

(1) That is, a step of acquiring data including a type of polishing process and a product type of a wafer to be processed, or an identification of a mask used for forming a wiring below a film to be polished and data of the film thickness before CMP which is a test result of the wafer to be processed, (2) a step of acquiring a polishing condition data, film thickness data before CMP, and film thickness data after CMP of a test wafer in a monitor process for confirming performance of equipment used for the polishing of a wafer to be processed, or acquiring a polishing condition data, film thickness data before CMP, and film thickness data after CMP of a wafer in the previous process before the polishing, (3) a step of selecting a within-wafer distribution model of a removal rate which represent a distribution of the removal rate within the wafer, a within-wafer distribution model of a film thickness before/after CMP which is a model representing the film thickness before/after CMP, and a within-wafer distribution model of a polishing process which is a model representing the passage of time in the polishing, (4) a step of obtaining a within-wafer distribution of the film thickness before/after CMP by determining the parameter of the within-wafer distribution model before/after CMP selected in the step (3) based on the data acquired in the step (2), (5) a step of obtaining a within-wafer distribution of the removal rate by determining the parameter of the within-wafer distribution model of the removal rate acquired in the step (3) based on the within-wafer distribution of the film thickness before/after CMP obtained in the step (4), the data acquired in the step (2), and the within-wafer distribution model of the polishing process selected in the step (3), (6) a step of selecting the within-wafer distribution model of the polishing process corresponding to the within-wafer distribution model of the film thickness after CMP for estimating the film thickness after CMP of the wafer in the process, (7) a step of obtaining the within-wafer distribution of the film thickness before CMP by determining a parameter of the within-wafer distribution model of the film thickness before CMP of the wafer in the process based on the data acquired in the step (1), (8) a step of determining a polishing condition with the restriction that the film thickness at each position in the within-wafer distribution of the film thickness after CMP satisfies the control limit by estimating the thickness in the polishing process with passage of time based on the within-wafer distribution of the removal rate obtained in the step (5), the within-wafer distribution model of the polishing process selected in the step (6), and the within-wafer distribution of the film thickness before CMP obtained in the step (7), (9) a step of acquiring the polishing condition data, the film thickness data before CMP, and the film thickness data after CMP with respect to a plurality of wafers which has been processed before,

(10) a step of estimating the variation between wafers directly based on the film thickness data after CMP acquired in the step (9) or estimating the variation in the film thickness after CMP between wafers based on the variation between wafers estimated from the film thickness data before CMP and the variation in the removal rate between wafer processes estimated from the polishing condition data, the film thickness data before CMP and the film thickness data after CMP,

(11) a step of determining whether or not the process is started based on the probability of deviation from the control limit by comparing the margin of the film thickness after CMP for the upper control limit and the lower control limit determined in the step (8) with the variation in the film thickness after CMP between wafers estimated in the step (10), and

(12) a step of performing a process for determining a condition for adjusting the parameters of each model when it is determined that the process cannot be started in the step (11).

According to the present invention, by polishing a monitor wafer or acquiring the past process result in order to monitor the removal rate of the polishing equipment and estimating the parameters (coefficient) of the within-wafer distribution model of the polishing process and the within-wafer distribution model of the film thickness before/after CMP to determine the within-wafer distribution of the removal rate, it becomes possible to accurately estimate the within-wafer distribution of the removal rate in the polishing equipment at the time of starting the process of the product wafer. Furthermore, it is also possible to estimate the within-wafer distribution of the removal rate regardless of the chip size and the arrangement of the chips on the wafer by setting the film thickness before/after CMP, the removal rate, and the polishing process as the within-wafer distribution models.

Furthermore, according to the present invention, it is possible to accurately estimate the film thickness after CMP by modeling the polishing process depending on the polishing condition on the basis of the within-wafer distribution of the removal rate in accordance with the type of the product and the film to be the object. As a consequence, it is possible to determine the polishing condition by a common system and to estimate the within-wafer distribution of the removal rate even in the polishing of the wide variety of structures including an interlayer insulating film and the like.

Furthermore, according to the present invention, it is possible to determine the condition which can provide the within-wafer distribution of the film thickness after CMP which satisfies the restrictive condition with respect to the control limit based on the within-wafer distribution model of the polishing process and the within-wafer distribution of the removal rate which have a polishing condition as parameters obtained from the within-wafer distribution of the film thickness before CMP of the product wafer to be processed. As a consequence, it is possible to determine the polishing condition in which the margin of the maximum value and the minimum value of the film thickness after CMP with respect to the control limit becomes largest and to prevent the deviation of the film thickness after CMP (failure of the process) resulting from the variation in the polishing.

Furthermore, according to the present invention, it is possible to prevent a failure in the product wafer in advance by estimating the variation in the film thickness after CMP of the product wafer based on the result of the process of the past product at the time of starting the process and comparing the margin of the within-wafer distribution of the film thickness after CMP with respect to the control limit with the variation in the film thickness after CMP to determine whether or not the process is started.

BRIEF DESCRIPTIONS OF THE DRAWINGS

These and other features, objects and advantages of the present invention will become more apparent from the following description when taken in conjunction with the accompanying drawings wherein.

Figure 15:
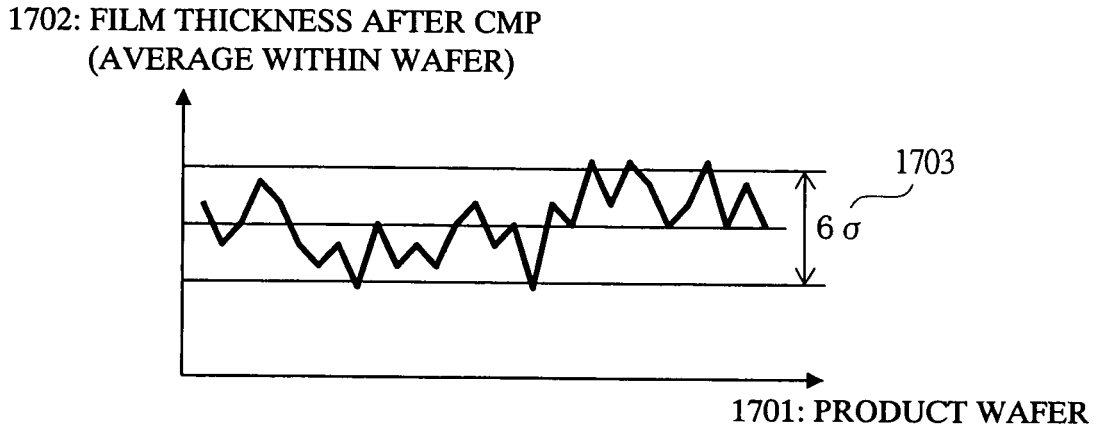
Figure 16:
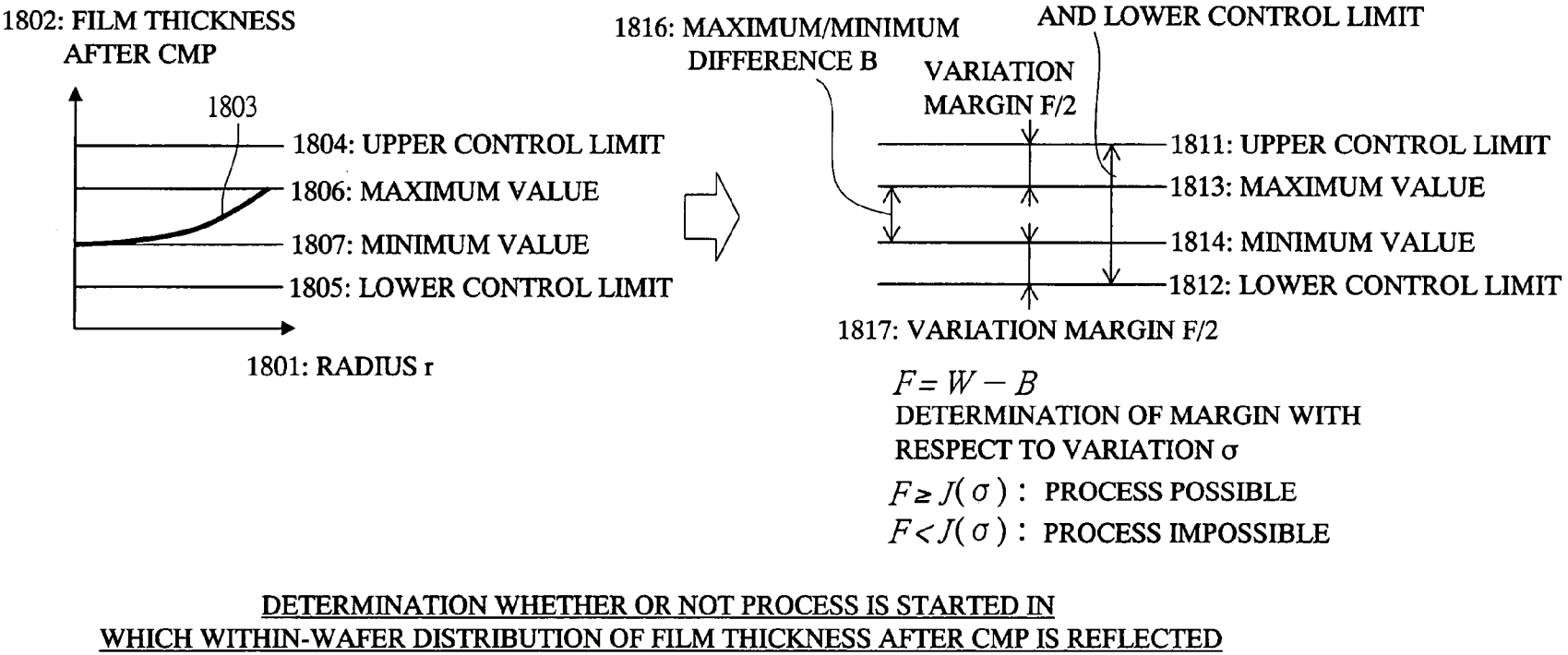

FIG. 15 is an explanatory diagram showing a trend of the film thickness after CMP for each of the product wafers according to an embodiment of the present invention; and FIG. 16 is an explanatory diagram showing a method for determining whether or not the process is started, in which the within-wafer distribution of the film thickness after CMP is reflected according to an embodiment of the present invention.

DESCRIPTIONS OF THE PREFERRED EMBODIMENTS

Hereinafter, embodiments of the present invention will be described in detail with reference to the accompanying drawings.

An example of the system configuration and process flow for realizing a method for polishing a wafer according to an embodiment of the present invention will be described with reference to FIGS. 1 to 16.

Figure 1:
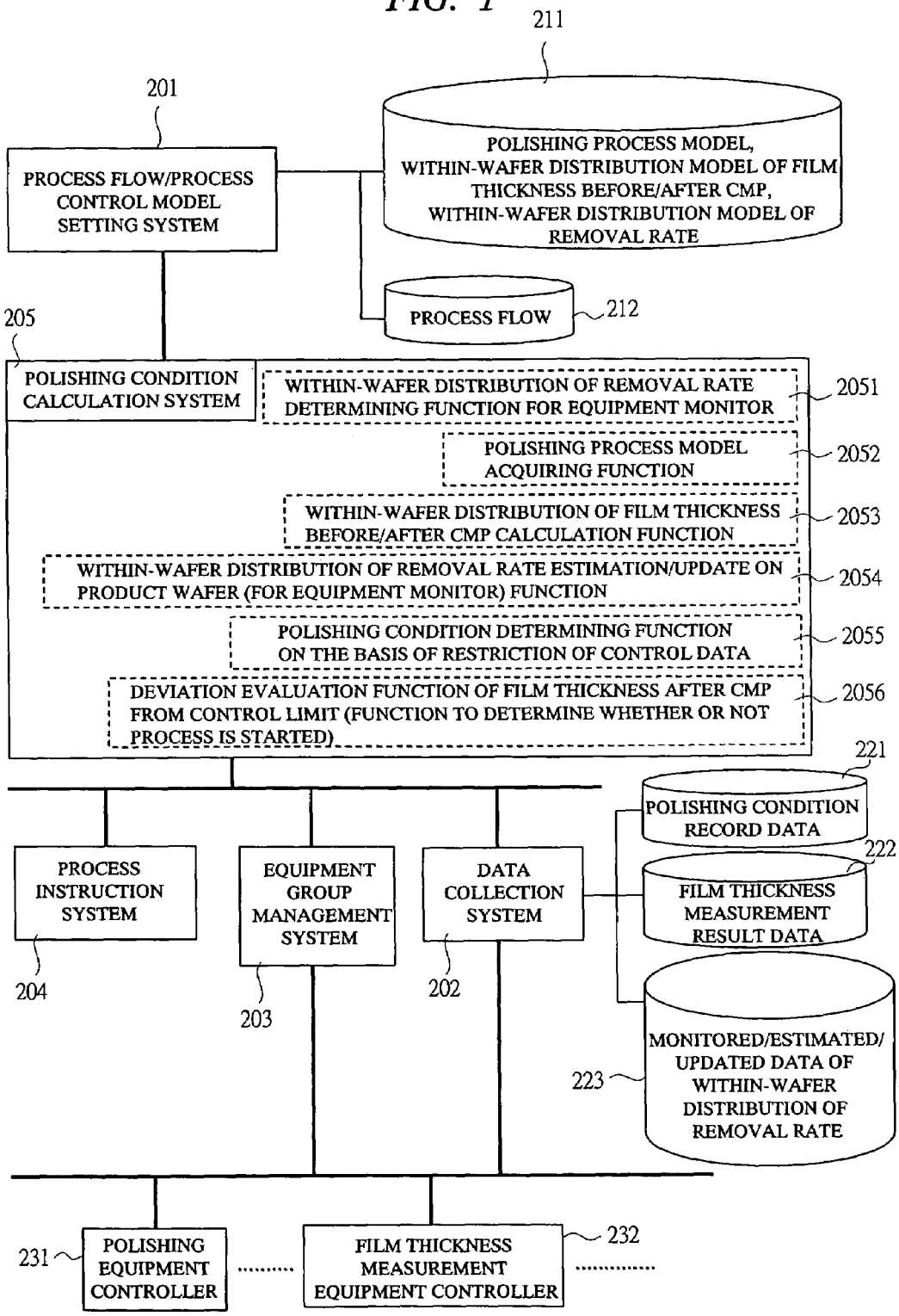
FIG. 1 is a block diagram showing a system for realizing a method for polishing a wafer according to an embodiment of the present invention.

First, an example of the system configuration for realizing a method for polishing a wafer according to an embodiment of the present invention will be described with reference to FIG. 1. FIG. 1 shows the system configuration.

The system for realizing a method for polishing a wafer according to this embodiment comprises a process flow/process control model setting system 201, a data collection system 202, an equipment group management system 203, a process instruction (man/machine interface) system 204, and a polishing condition calculation system 205.

A database (model database) 211 of a within-wafer distribution model of the polishing process (hereinafter referred to as a polishing process model), a within-wafer distribution model of the film thickness before/after CMP, and the within-wafer distribution model of the removal rate and the database 212 of the process flow are connected to the process flow/process setting model setting system 201.

A database 221 of the polishing condition record data, a database 222 of the film thickness measurement result data, and a database 223 of monitored/estimated/updated data of the within-wafer distribution of the removal rate are connected to the data collection system 202. A polishing equipment controller 231 and a film thickness measurement equipment controller 232 are connected to the equipment group management system 203.

In the system with the configuration as described above, the polishing equipment and the film thickness measurement equipment in the production line or in the production shop are controlled by the polishing equipment controller 231 and the film thickness measurement equipment controller 232. The polishing equipment controller 231 and the film thickness measurement equipment controller 232 are connected to the equipment group management system 203 via a network. In accordance with a recipe which is set in the equipment group management system. 203, the equipment group management system 203 outputs an instruction to each of the controllers so that the equipment is automatically operated. In the case where the equipment is not connected to the equipment group control system 203 via the network or a remote operation is not enabled, an operator directly operates the equipment in accordance with the condition displayed on the process instruction system 204.

The equipment group control system 203, the process instruction system 204, the polishing equipment controller 231, and the film thickness measurement equipment controller 232 are connected to the data collection system 202 via a network. The information of the lot and the wafer processed in the polishing equipment, the usage history of the fixings used in the polishing equipment, the history of the process of the lot and the wafer, and the content of the recipe at the time of processing are stored in the database 221 for the process result, and the information of the lot and the wafer which are subjected to the inspection with the film thickness measurement equipment and the information at each of the measurement sites and thickness thereof are stored in the database 222 for the film thickness measurement result.

Furthermore, the within-wafer distribution of the removal rate obtained from the processing record data and the film thickness measurement result data is stored in the database 223 for the monitored/estimated/updated data of the within-wafer distribution of the removal rate, is updated for each registration of the film thickness after CMP of the lot and the wafer, and is always updated to the state of the most recent within-wafer distribution of the removal rate in the equipment.

The polishing process model, the within-wafer distribution model of the film thickness before/after CMP, the within-wafer distribution model of the removal rate, and the process flow for calculating the polishing condition and determining the recipe are defined in the process flow/process control model setting system 201, and the defined contents are stored in the databases 211 and 212, respectively.

Based on the within-wafer distribution of the removal rate surface in the polishing equipment, the polishing process unique to the product wafer, and the within-wafer distribution of the film thickness before/after CMP, the polishing condition is determined so that the film thickness after CMP satisfies the control limit. Furthermore, the polishing condition calculation system 205 which determines whether or not the process of a product wafer is started is provided with a within-wafer distribution of removal rate determining function 2051 for equipment monitor which determines the within-wafer distribution of the removal rate based on the result of the process of the wafer for the equipment monitor, a polishing process model acquiring function 2052 which acquires the polishing process model in accordance with the product to be processed in which the polishing process model is determined in accordance with the product wafer (namely, the product type and the type of the film to be polished), a within-wafer distribution of film thickness before/after CMP calculation function 2053 which calculates the within-wafer distribution of the film thickness based on the film thickness data obtained from the measurement of the film thickness of the product wafer, a within-wafer distribution of removal rate on product wafer estimation/update function 2054 which obtains the within-wafer distribution of the removal rate based on the film thickness of a product wafer before/after CMP and the polishing condition, and a polishing condition determining function 2055 on the basis of restriction of control data which determines the polishing condition with the restriction that the film thickness after CMP is set within the control limit, and a deviation evaluation function 2056 of film thickness after CMP from control limit (function to determine whether or not process is started) which determines whether or not the process is started by evaluating the probability that the film thickness after CMP is deviated from the control limit.

Figure 2:
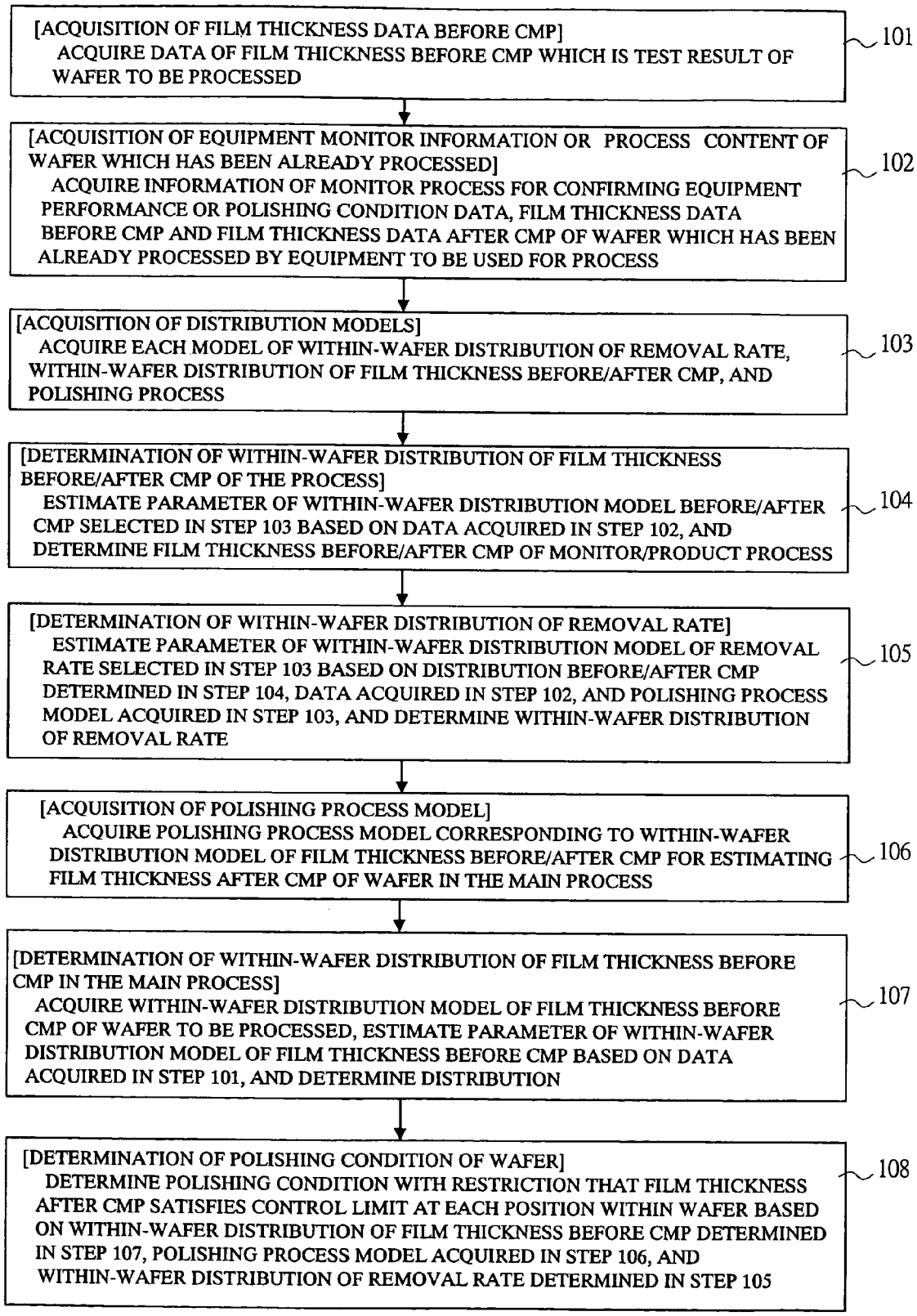
FIG. 2 is a flowchart showing a method for determining the process recipe of the wafer in the system for realizing a method for polishing a wafer according to an embodiment of the present invention.
Figure 3:
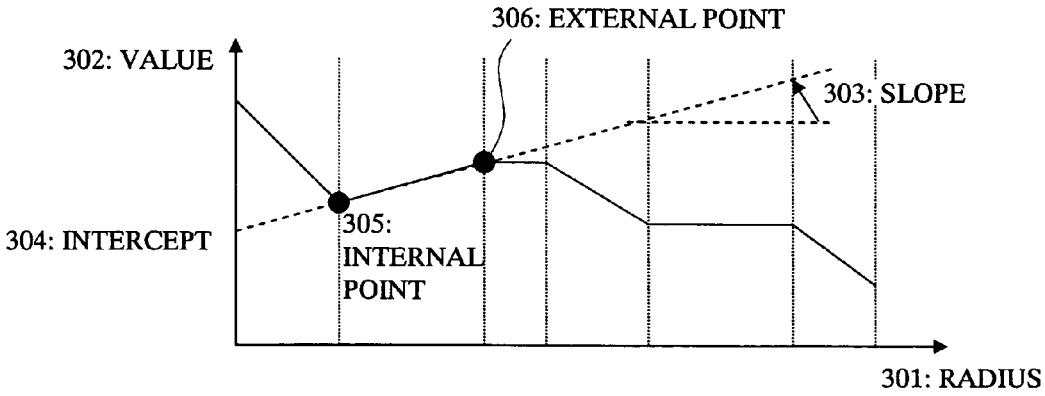
FIG. 3 is an explanatory diagram showing a distribution model in a radial direction within the wafer according to an embodiment of the present invention.
Figure 4:
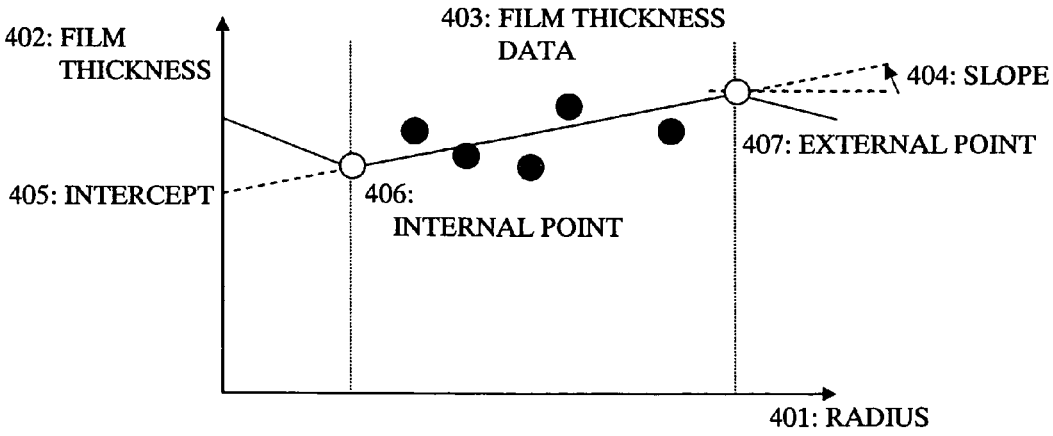
FIG. 4 is an explanatory diagram showing a method for estimating a distribution in a radial direction within the wafer according to an embodiment of the present invention.
Figure 5:
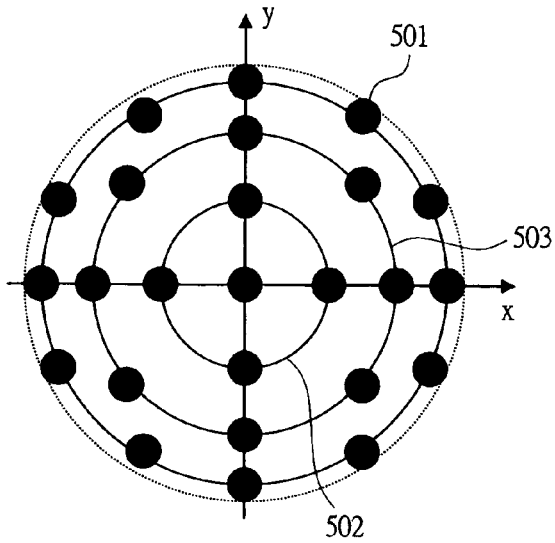
FIG. 5 is an explanatory diagram showing measurement sites which is set on the same radial circumference according to an embodiment of the present invention.
Figure 6:
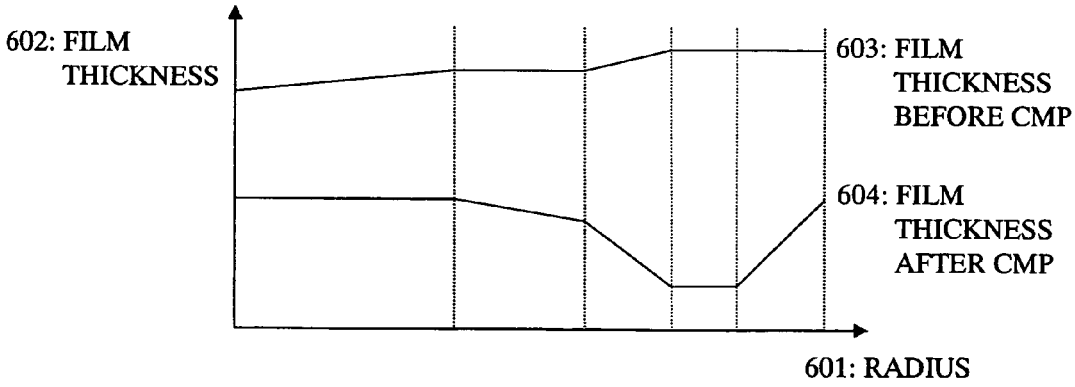
FIG. 6 is an explanatory diagram showing a distribution of the film thickness before/after CMP in the radial direction of the monitor wafer according to an embodiment of the present invention.
Figure 7:
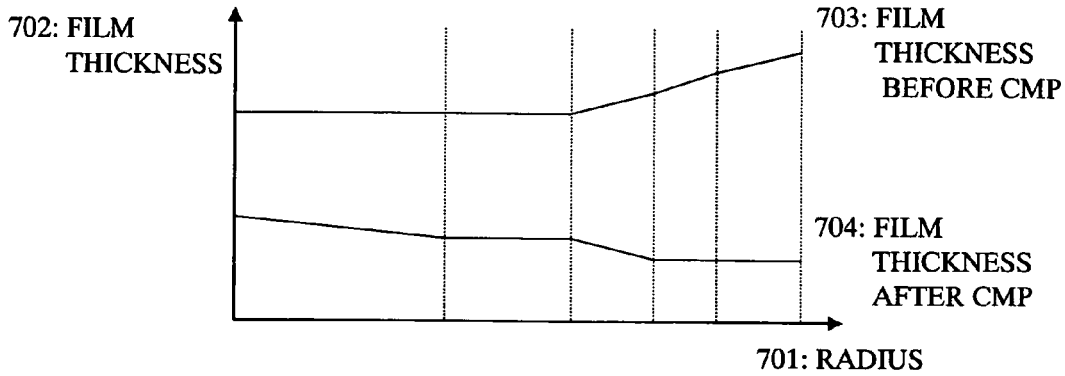
FIG. 7 is an explanatory diagram showing a distribution of a film thickness before/after CMP in a radial direction of the product wafer according to an embodiment of the present invention.
Figure 8:
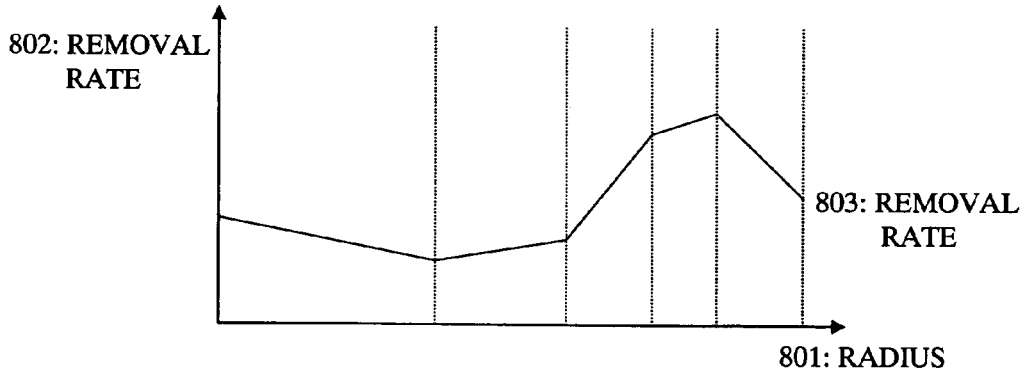
FIG. 8 is an explanatory diagram showing a distribution of the removal rate in a radial direction according to an embodiment of the present invention.
Figure 9:
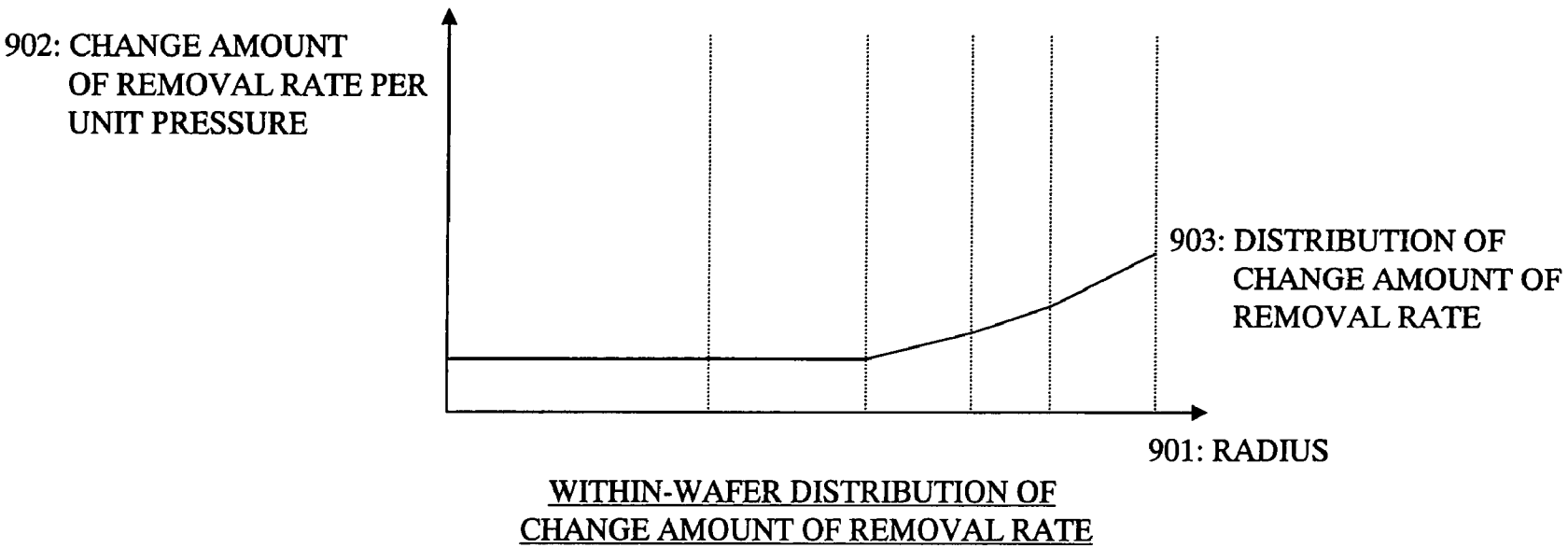
FIG. 9 is an explanatory diagram showing a change amount of the removal rate in the radial direction due to the change in parameters according to an embodiment of the present invention.
Figure 10:
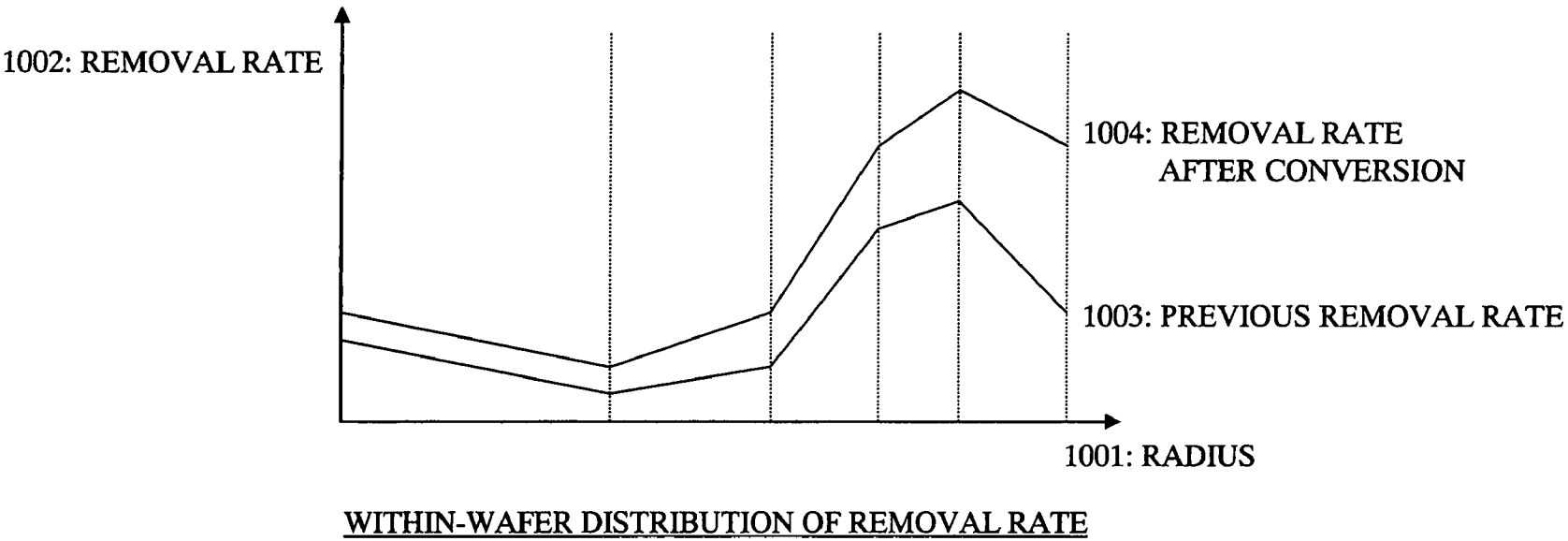
FIG. 10 is an explanatory diagram showing a change in a distribution of the removal rate in the radial direction due to the change in parameters according to an embodiment of the present invention.
Figure 11:
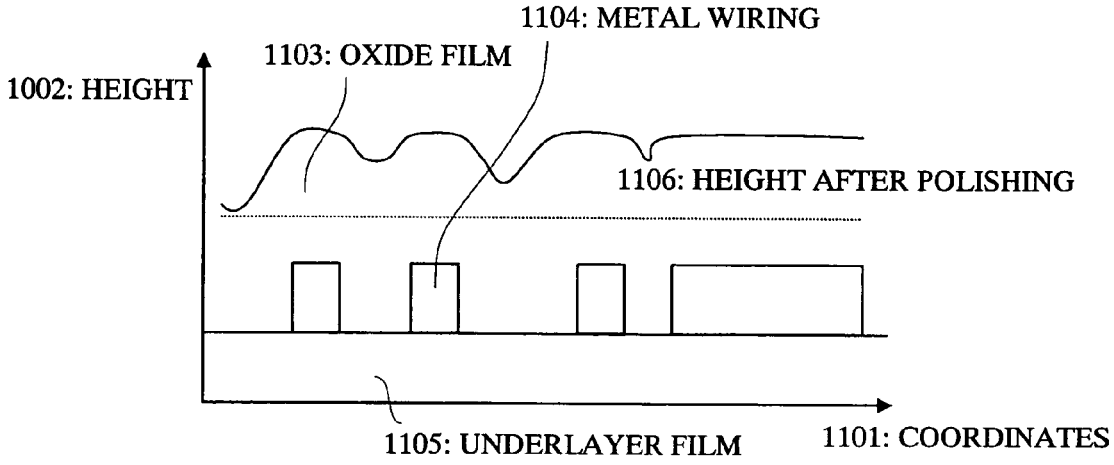
FIG. 11 is an explanatory diagram showing a film before CMP in which an oxide film is deposited on a metal wiring according to an embodiment of the present invention.
Figure 12:
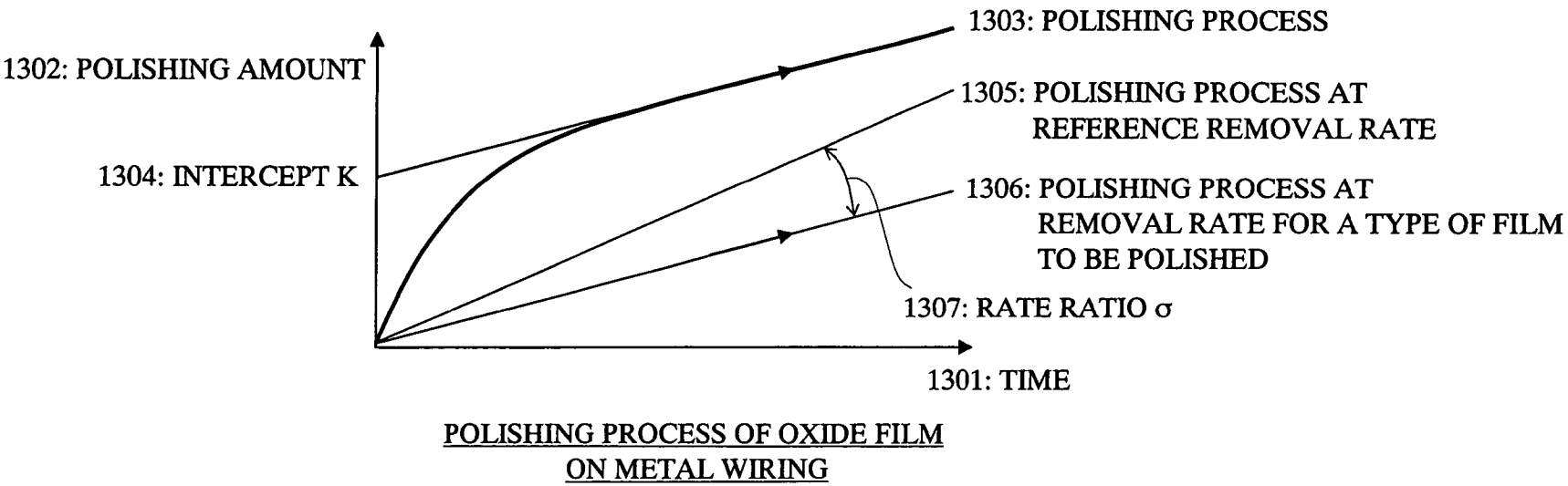
FIG. 12 is an explanatory diagram showing a polishing process of a film in which an oxide film is deposited on a metal wiring according to an embodiment of the present invention.
Figure 13:
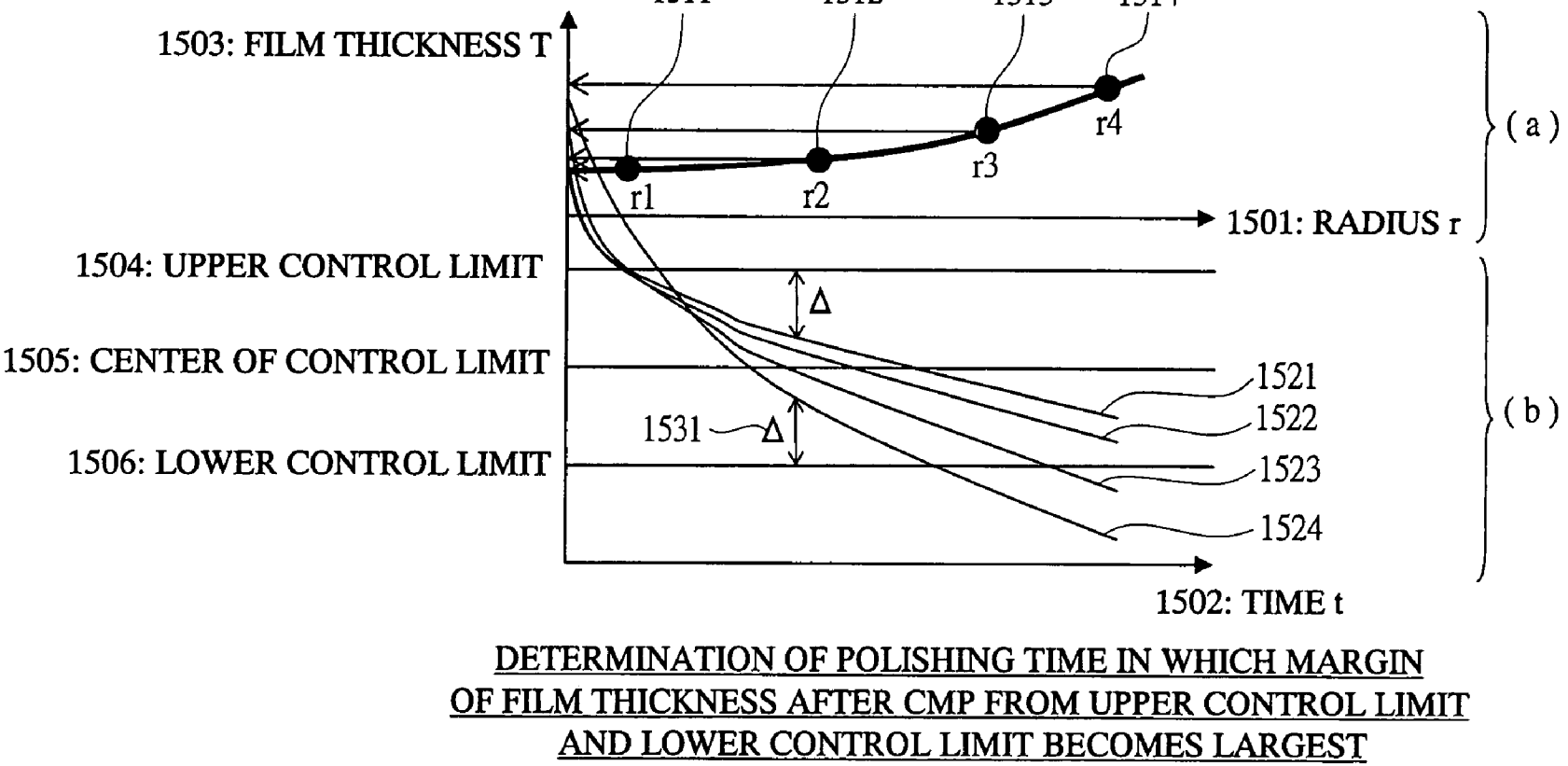
FIG. 13 is an explanatory diagram showing a method for determining a polishing time in which the margin of the film thickness after CMP from the upper control limit and the lower control limit becomes largest according to an embodiment of the present invention.

Subsequently, based on FIG. 2 and with reference to FIGS. 3 to 13, an example of a process flow of a method for determining a process recipe of a wafer in the system for realizing a method for polishing a wafer according to this embodiment of the present invention will be described. Respectively, FIG. 2 shows a method for determining a process recipe of the wafer, FIG. 3 shows a distribution model in a radial direction within the wafer, FIG. 4 shows a method for estimating a distribution in a radial direction within the wafer, FIG. 5 shows measurement sites set on the same radial circumference, FIG. 6 shows a distribution of the film thickness before/after CMP in a radial direction of the monitor wafer, FIG. 7 shows a distribution of the film thickness before/after CMP in a radial direction of the product wafer, FIG. 8 shows a distribution of the removal rate in a radial direction, FIG. 9 shows a distribution of a change amount of the removal rate in a radial direction due to the parameter change, FIG. 10 shows a change in a distribution of the removal rate in a radial direction due to the parameter change, FIG. 11 shows a film before CMP in which a metal oxide film is deposited on a metal wiring, FIG. 12 shows the polishing process of the film in which an oxide film is deposited on the metal wiring, and FIG. 13 shows a method for determining polishing time in which the margin of the film thickness after CMP from the upper control limit and the lower control limit becomes largest.

In this embodiment, the process flow of the method for determining a process recipe is started before the start of the process of a product wafer or at the time of the start thereof.

First, in step 101, data of the film thickness before CMP including the information of the measurement sites of the product wafer to be processed is acquired.

Next, in step 102, the polishing condition data and the data of film thickness before/after CMP in the monitor process for confirming the equipment performance in which the process and the measurement have been already finished are acquired by the equipment for performing the process of the product wafer. Alternatively, the polishing condition data and the data of film thickness before/after CMP of a product wafer are acquired.

Here, the monitor process for confirming the equipment performance refers to the test process for evaluating the polishing performance of the polishing equipment (for example, removal rate, uniformity and number of dust particle/contamination within wafer), and the wafer used for this monitor refers to a wafer which does not include product LSI chips or a wafer in which a TEG (Test Element Group) with simple pattern is arranged. In such a monitor wafer, the film thickness can be measured at arbitrary sites or at many sites as compared with a wafer having product LSI chips arranged thereon, and a wafer with a simple structure, that is, the number of laminated films is one or two can be preferably used.

Next, in step 103, the within-wafer distribution of the removal rate, the within-wafer distribution of the film thickness before/after CMP, and the polishing process model are selected on the basis of the type of the product LSI chip of the product wafer, the type of the film and laminated structure of the film to be polished.

The within-wafer distribution model of the removal rate and the within-wafer distribution model of the film thickness before/after CMP refer to the models in which the removal rate and the film thickness before/after CMP can be estimated at each position within the wafer. The within-wafer distribution model of the removal rate and the within-wafer distribution model of the film thickness before/after CMP are set as parametric models in the coordinate system with respect to a line segment and a curved line segment in the radial section in a radial direction or a plane surface and a curved surface in an arbitrary area on the wafer. Furthermore, the within-wafer distribution model of the removal rate includes as parameters the size based on the equipment configuration, the setting value to the equipment, the type of the polishing process, the type of the wafer or the LSI chip, the type of the polishing process, and the physical characteristic of the wafer or the LSI chips.

Furthermore, in the case where a film with a step height on the surface thereof is formed through the process flow of metal deposition, photography, metal etching, and the insulating film deposition as the previous process of the polishing, the polishing process model has, as a parameter, an amount obtained by subtracting the polishing amount in the case of polishing a planar insulating film in the same time from the polishing amount obtained from the difference in the film thickness before/after CMP at the thickness measurement site which is determined by polishing a surface step height. Also, the polishing process model has, as a parameter, a ratio of the removal rate which changes depending on the polishing condition with respect to the within-wafer distribution of the reference removal rate and the material type of the film or process condition.

FIG. 3 shows a model in which the radius is interpolated with a line segment in each section with respect to the radial direction 301. In the case of such a model, it is possible to estimate a removal rate and a film thickness before/after CMP at an arbitrary radius by obtaining a slope 303 and an intercept 304 of a line segment between each sections or by obtaining an internal point 305 and an external point 306 based on the value 302 of the measurement result of the film thickness and the calculation result of the removal rate.

As such a distribution model in a radial section, it is possible to set a parametric curve such as a Bezier curve and a NURBS (a non-uniform rational B spline curve) or various types of analysis curves, and the parameters for defining respective curves can be estimated based on the measurement result of the film thickness and the calculation result of the removal rate. Also, it is also possible to set a single curve model over the entire radius without defining it in a radius section.

Furthermore, when the inside of the wafer is partitioned into mesh to determine the parameters of the plane in each partitioned sections (line segments of x and y for determining sections and a normal vector for determining a plane), it is possible to estimate the film thickness before/after CMP and the removal rate thereof at each position within the wafer. It is also possible to set the model as a parametric curved surface such as a Bezier curved surface and a NURBS or various types of analysis curved surfaces instead of the plane surface and further to set a model as spatial predictor such as models by Kriging method.

Next, in step 104, the parameter of the within-wafer distribution of the film thickness before/after CMP selected in step 103 is estimated based on the data of film thickness before/after CMP acquired in step 102. More specifically, the parameter of the model in the radial section or a region is determined based on the data before/after CMP at the coordinate of the measurement site and the adjacent information in the radial section or the region.

FIG. 4 shows a relation between the film thickness at the measurement site and a straight line segment estimated from the film thickness (horizontal axis: radius 401, vertical axis: thickness 402). There are five points of the film thickness data 403 in a certain radial section. It is possible to determine the distribution by obtaining, for example, a slope 404 and an intercept 405 of a straight line or an internal point 406 and an external point 407 by means of a least square method using the five points. Furthermore, in the case where the film thickness measurement site 501 is set as shown in FIG. 5, the internal point 406 and the external point 407 can be determined by taking an average of the film thickness at the measurement sites located on the circumferences 502 and 503 having the same radius.

Next, in step 105, the within-wafer distribution model of the removal rate is determined by estimating a parameter of the within-wafer distribution model of the removal rate selected in step 103 based on the within-wafer distribution of the film thickness before/after CMP determined in step 104, the data acquired in step 102, and the polishing process model acquired in step 103.

Here, the polishing process model in the case of the polishing of the monitor wafer is represented in equation (1), and the polishing process model in the case of the polishing of the product wafer is represented in equation (2).

[Mathematical Expression 1]

$$TA(r)=TB(r)-t\times RR(r) \quad \text{Expression (1)}$$

[Mathematical Expression 2]

$$TA(r)=TB(r)-t\times C(r)\times RR(r) \quad \text{Expression (2)}$$

In this case, r denotes a radius, TA denotes a film thickness after CMP, TB denotes a film thickness before CMP, t denotes polishing time, and RR denotes a removal rate. In respective cases, when the film thicknesses 603 and 703 before CMP and the film thicknesses 604 and 704 after CMP are distributed as shown in FIG. 6 and FIG. 7 (horizontal axis: radius 601 and 701, vertical axis: film thicknesses 602 and 702), it becomes possible to estimate the within-wafer distribution of the removal rate 803 along the radial position by the expressions 3 and 4 as shown in FIG. 8 (horizontal axis: radius 801, vertical axis: removal rate 802). In the estimation of the within-wafer distribution of the removal rate of the product wafer, the configuration of the removal rate distribution of FIG. 8 cannot be directly determined from the difference in the film thickness before/after CMP of FIG. 7 due to C in the Mathematical Expression (2).

[Mathematical Expression 3] Expression (3)

$$RR(r)=\frac{TB(r)-TA(r)}{t}$$

[Mathematical Expression 4] Expression (4)

$$RR(r)=\frac{TB(r)-TA(r)}{C(r)\times t}$$

The removal rate which is a performance of the process differs depending on the consumption state of each portion such as a pad, a grid, and a head to be used, variable parameters such as a pressure, the flow rate of the slurry, the revolution/rotation speed of the platen set in the equipment, the type of the wafer to be polished (type of product LSI chip), and the material type of the film.

Then, the change in the within-wafer distribution of the removal rate is modeled by using these parameters so as to obtain the reference of the within-wafer distribution of the removal rate which is required for the determination of the polishing condition. For example, the change amount distribution 903 of the removal rate with respect to the change in the pressure is shown in FIG. 9 (horizontal axis: radius 901, vertical axis: change amount 902 of the removal rate per unit pressure). This model is made in a manner of a straight line for each of the radius section with respect to the pressure as shown in Expression (5). A removal rate 1004 after conversion with respect to the previous removal rate 1003 in the within-wafer distribution of the removal rate after pressure change is shown in FIG. 10 (horizontal axis: radius 1001, vertical axis; removal rate 1002).

[Mathematical Expression 5]

$$RR(r,p)=G(r,p-p0)\times RR(r,p0) \quad \text{(Expression 5)}$$

Note that the Mathematical Expression (5) can be defined as being included in the polishing process model of Mathematical Expression (3) and Mathematical Expression (4).

Next, in step 106, a polishing process model is acquired, which corresponds to the within-wafer distribution of the film thickness before/after CMP for estimating the film thickness after CMP of the product wafer to be processed. This polishing process model includes as parameters a size based on the equipment configuration, a setting value to the equipment, the type of the polishing process, the type of the wafer and the LSI chip, the type of the polishing process, and the physical characteristic of the wafer or the LSI chip.

In the CMP, for example, a film with the structure in which an oxide film 1103 is deposited on a metal wiring 1104 (lower layer film 1105 and height 1106 after polishing) as shown in FIG. 11 (horizontal axis: coordinates 1101, vertical axis: height 1102) is polished.

In the case where a film shown in FIG. 11 is polished, the polishing process (polishing amount) with respect to the time differs between the time when the step height portion is polished and the time when the portion after the removal of the step height is polished. Furthermore, the removal rate differs from the reference removal rate due to the difference in the type of the film to be polished and the polishing condition. FIG. 12 is a graph of the polishing process of the film shown in FIG. 11 in which a horizontal axis is taken as time 1301 and a vertical axis is taken as a polishing amount 1302. In the polishing process 1303 of the film, the polishing proceeds fast when the step height is polished. Furthermore, the removal rate differs from the reference removal rate due to the difference in the film thickness, and a ratio 1307 is applied in the rate in the respective polishing process 1305 and the polishing process 1306. Assuming that the step height is completely eliminated in the film thickness after CMP, the polishing amount of the step height portion can be estimated by providing a parameter of the intercept K1304 of the graph. As a consequence, the polishing process can be modeled as shown in the Mathematical Expression (6).

[Mathematical Expression 6]

$$TA(r)=TB(r)-t\times\sigma(r)\times RR(r)-K(r) \quad \text{(Expression 6)}$$

Next, in step 107, a within-wafer distribution model of the film thickness before CMP in the process of the product wafer is acquired and a parameter of the within-wafer distribution model of the film thickness before CMP is estimated based on the data acquired in step 101, thereby determining the distribution. In this method, a method similar to that described in step 104 is taken as an example. Finally, in step 108, based on the within-wafer distribution of the film thickness before CMP determined in step 107, the polishing process model acquired in step 106, and the within-wafer distribution of the removal rate determined in step 105, the polishing condition is determined with the restriction that the film thickness after CMP satisfies the control limit at each position.

For the description, the polishing process model is represented in the above-described Expression (6). In FIG. 13, the distribution (a) of the film thickness before CMP at each of the positions (radius r1501) within the wafer surface and a graph (b) of the polishing processes of each of the film thicknesses in which a film thickness T1503 is taken on the vertical axis and time t1502 is taken on the horizontal axis are shown in combination.

The film thicknesses before CMP at each of the positions r1 1511, r2 1512, r3 1513 and r4 1514 are different respectively, and the polishing processes 1521, 1522, 1523 and 1524 are different respectively because the removal rate PR, the intercept K, and the removal rate ratio σ are changed depending on the radial positions. The polishing time is obtained with the restriction that a distance Δ 1531 between the upper and lower control limits and the maximum and minimum film thicknesses after CMP (difference between the upper control limit and the maximum film thickness after CMP, difference between the lower control limit and the minimum film thickness after CMP) becomes equal. Namely, the following Expression (7) is provided as the restriction.

[Mathematical Expression 7]

$$\Delta = TUCL - \max TA(r) = \min TA(r) - TLCL \quad \text{(Expression 7)}$$

Here, TUCL denotes an upper control limit of the film thickness after CMP, TLCL denotes a lower control limit of the film thickness after CMP, max and min denote a maximum value and a minimum value, respectively.

The polishing process model expression (6) is a linear equation of time t. Therefore, the desired polishing time can be determined in the following manner. That is, a limited number of radial positions r are discretely selected to calculate the polishing time capable of satisfying the equation (7) at two radial positions, and then, the polishing time capable of making the predicted values of the film thickness after CMP in the calculated polishing time be maximum and minimum at two positions is determined.

Alternatively, the desired polishing time can be obtained in the following manner. That is, the polishing time is proceeded by each minute time to calculate the radius distribution of the predicted values of the film thickness after CMP at each point of time, and the minimum and the maximum thereof are obtained. Then, it is determined whether or not the maximum and the minimum thereof satisfy Mathematical Expression (7).

Incidentally, an example of a restriction that an interval between the upper and lower control limits and the minimum and maximum of the film thickness after CMP becomes equal to each other has been described above. However, the restriction for the distance between the minimum value and the lower control limit, the restriction that the average value within the wafer is set to a center of the control limit, and the restriction that the central value within the wafer is set to a center of the control limit are also available.

Furthermore, in this example, the polishing time is determined as a polishing condition. However, it is also possible to determine variable parameters such as a pressure set in other equipment, a flow rate of slurry, and a revolution/rotation speed of the platen as the polishing conditions.

In the foregoing, an example of a process flow of a method for determining a process recipe of a wafer in a system for realizing a method for polishing a wafer according to this invention has been described.

Figure 14:
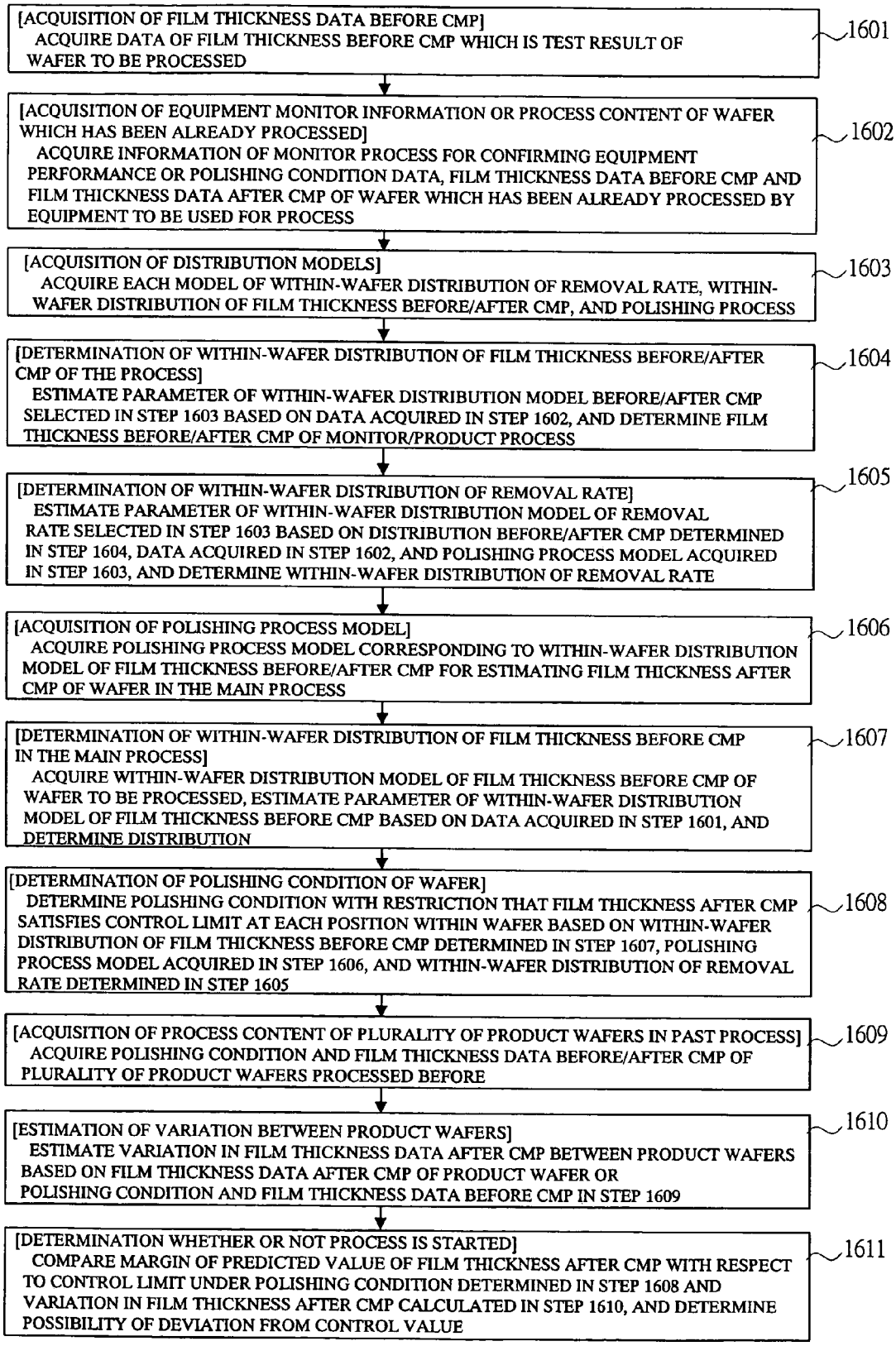
FIG. 14 is a flowchart showing a method for determining whether or not the process is started in the fabrication of wafers according to an embodiment of the present invention.

Subsequently, an example of a process flow of a method for determining whether or not the process is started in the fabrication of the wafer in a system for realizing a method for polishing a wafer according to this embodiment will be described based on FIG. 14 and with reference to FIGS. 15 and 16. Respectively, FIG. 14 shows a method for determining whether or not the process is started, FIG. 15 shows a trend of a film thickness after CMP for each product wafer, and FIG. 16 shows a method for determining whether or not the process is started in which the within-wafer distribution of the film thickness after CMP is reflected.

When such polishing is performed in the process for the product wafer, the film thickness after CMP is deviated from the control limit, and as a result, the film is polished improperly or overpolished in some cases. For its prevention, a method for determining the possibility that the film thickness after CMP is deviated from the control limit before the start and determining whether or not the process is started has become necessary.

Since the process from step 1601 to step 1608 is completely the same as that from the step 101 to step 108 of a method for determining a wafer process recipe shown in FIG. 2, the description thereof is omitted here. Thus, the within-wafer distribution of the prediction values of the film thickness after CMP has been already determined in step 1608.

In step 1609, the polishing condition of a plurality of product wafers which has been processed before and the data of the film thickness before/after CMP are acquired.

Next, in step 1610, data of the variation in the film thickness after CMP of the product wafers acquired at step 1609 is estimated. FIG. 15 shows a trend of the film thickness after CMP and a size of the variation 6σ (1703) of each product wafer (horizontal axis: product wafer 1701, vertical axis: film thickness after CMP (average within the wafer) 1702). The size of variation can be evaluated with, for example, a standard deviation σ. Alternatively, the film thickness after CMP is predicted based on the film thickness before CMP, the polishing condition data and the removal rate to estimate the variation in the film thickness after CMP. In the case where the polishing process model is determined by Mathematical Expression (6), Mathematical Expression (8) and Mathematical Expression (9) are established to estimate the film thickness after CMP thereby calculating the standard deviation. In this example, the polishing condition is polishing time and the parameters of other model are fixed. The reference symbol i denotes an element number of the sample.

[Mathematical Expression 8] (Expression 8)

$$\check{T}A[i] = TB^*[i] - t^*[i] \times \sigma \times RR^*[i] - K$$

[Mathematical Expression 9] (Expression 9)

$$\sigma = \frac{1}{n}\sum_{i=1}^{n} TA[i]$$

Finally, in step 1611, the possibility of the deviation from the control limit is determined by comparing the margin of the predicted value of the film thickness after CMP with respect to the control limit under the polishing condition determined in step 1608 and a variation of the film thickness after CMP which is calculated in step 1610.

The processing content is shown in FIG. 16 (horizontal axis: radius r1801, vertical axis: film thickness after CMP 1802). In the case where the film thickness 1803 after CMP is predicted for the radius r1801, the maximum value 1806 and the minimum value 1807 are obtained. With respect to the relation between the control limit and the film thickness after CMP, a difference between the upper control limit 1811 and the lower control limit 1812 is determined and set as a control limit difference W (1815) between upper control limit and lower control limit. Next, a difference between the maximum value 1813 and minimum value 1814 of the film thickness after CMP is obtained and set as a maximum/minimum difference B (1816). The margin F of the variation is determined by subtracting the maximum/minimum difference B (1816) from the control limit difference W (1815). Since the polishing condition is determined with the restriction that the maximum value and the minimum value of the film thickness after CMP has the same interval from the upper control limit and the lower control limit, the variation margin is F/2 (1817) on one side.

When the variation margin F is sufficiently large with respect to the variation σ in film thickness after CMP, it is considered that the possibility of the deviation from the control limit is low and it is determined that the process can be started. That is, the determination is made with the Expression (10) and J is a determination function (σ).

[Mathematical Expression 10]

$F > J(\sigma)$: process start possible Expression (10)

For example, in the case where it is determined that the process can be started when the variation margin is larger than 6σ, $J(\sigma)=6\times\sigma$ is established.

In the foregoing, an example of a process flow of a method for determining whether or not the process is started in the fabrication of a wafer in a system for realizing a method for polishing the wafer according to this embodiment has been described.

As described above, according to the system configuration and the process flow for realizing a method for polishing a wafer of this embodiment, the within-wafer distribution of the removal rate is determined by the monitor process for monitoring the processing capability of the equipment or based on the film thickness before/after CMP and the polishing condition of a product wafer, and the film thickness after CMP is estimated based on the within-wafer distribution of the film thickness before CMP of the product wafer newly processed, the polishing process model in accordance with the type of the film to be processed and the product, and the within-wafer distribution of the removal rate. By doing so, the polishing condition capable of satisfying the restriction of the film thickness after CMP for the control limit is obtained. Also, the variation in film thickness after CMP with respect to the margin of the film thickness after CMP within the control limit is evaluated based on the estimation value of the variation in the film thickness after CMP in the past process result, the upper and lower control limits, and the maximum and minimum values of the film thickness after CMP, and the risk of the deviation of the film thickness after CMP from the control limit is evaluated. By doing so, it is determined whether or not the process is started. Therefore, the advantages as follows can be achieved.

(1) Since a function to determine a within-wafer distribution of the removal rate by the monitor process of the processing capability of the equipment or based on the film thickness before/after CMP and the polishing condition of the product wafer processed before and the polishing process model which differs depending on the product to be polished and the type of the film and structure is provided, it is possible to commonly determine the within-wafer distribution of the removal rate in any type of the film and any film structure.

(2) Since a function to estimate the distribution of the film thickness in the polishing process based on the within-wafer distribution of the film thickness before CMP and the within-wafer distribution of the removal rate of a product wafer to be processed and the polishing process model and a function to determine the polishing condition by adjusting the variable parameters in the within-wafer distribution model of the removal rate and the polishing process model so as to satisfy the restriction condition with respect to the control limit of the film thickness after CMP are provided, it is possible to determine a polishing condition which can make a film thickness after CMP uniform and can set the within-wafer distribution of the film thickness after CMP within the control limit with equal intervals from the upper control limit and the lower control limit, and also possible to reduce the defect caused by the deviation of the film thickness after CMP from the control limit due to the variation.

(3) Since a function to estimate the variation in the film thickness after CMP based on the polishing, of the product wafer to be processed and the past process result of the same product and film type/structure and a function to obtain the probability of the deviation of the film thickness after CMP from the control limit by comparing the margin for the control limit of the within-wafer distribution of the film thickness after CMP with the variation in the film thickness after CMP are provided, it is possible to determine whether or not the process can be started by predicting the occurrence of the failure at the process and also possible to prevent the failure in the process in advance.

In the foregoing, the invention made by the inventors of the present invention has been concretely described based on the embodiments. However, it is needless to say that the present invention is not limited to the foregoing embodiments and various modifications and alterations can be made within the scope of the present invention.

For example, the process flow of the method for determining a process recipe of the wafer and the fabrication method described in the above-described embodiments can be widely applied to the manufacturing method in which a process condition is determined with a certain restriction condition and the possibility of the deviation of the state after the process from the limitation is determined to evaluate the process even if the object to be processed is not the wafer, in the case where the process condition needs to be set for the object to be processed and a limitation such as the control limit is applied to the state after the process.

While we have shown and described several embodiments in accordance with our invention, it should be understood that disclosed embodiments are susceptible of changes and modifications without departing from the scope of the invention. Therefore, we do not intend to be bound by the details shown and described herein but intend to cover all such changes and modifications fall within the ambit of the appended claims.

What is claimed is:

1. A method of polishing a wafer, comprising:

a first step of selecting a within-wafer distribution model of a removal rate which represents a distribution of a removal rate within a wafer and a within-wafer distribution model of a polishing process which is a model representing a time passage in polishing;

a second step of obtaining a within-wafer distribution of a removal rate by determining a parameter of the within-wafer distribution model of the removal rate based on a within-wafer distribution of a film thickness before/after CMP of a polished wafer, data of a polishing condition and the within-wafer distribution model of the polishing process selected in said first step; and a third step of determining a polishing condition with a restriction that a film thickness at each position in the within-wafer distribution of the film thickness after CMP satisfies a control limit by estimating a film thickness in the polishing process from the passage of time based on said within-wafer distribution of the removal rate obtained in the second step, the within-wafer distribution model of the polishing process selected in said first step, and a film thickness of a wafer to be processed before CMP, wherein a polishing condition in which a film thickness after CMP of the wafer can be set within the control limit is determined on the basis of the film thickness before CMP at each measurement site of the wafer.

2. The method of polishing a wafer according to claim 1, wherein said first step selects a within-wafer distribution model of a film thickness before/after CMP which is a model representing a film thickness before/after CMP in addition to said within-wafer distribution model of the removal rate and said within-wafer distribution model of the polishing process, and said third step obtains a within-wafer distribution of a film thickness before CMP by determining a parameter of the within-wafer distribution model of a film thickness before CMP based on the film thickness before CMP of the wafer to be processed and estimates a film thickness in the polishing process from the passage of time based on said within-wafer distribution model of the removal rate and said within-wafer distribution model of the polishing process, thereby determining the polishing condition with a restriction that a film thickness at each position in the within-wafer distribution of the film thickness after CMP satisfies the control limit.

3. The method of polishing a wafer according to claim 2, wherein said first step includes:

a first (a) step of acquiring data including a type of polishing process and a product type of a wafer to be processed, or an identification of a mask used for forming a wiring below a film to be polished and data of a film thickness before CMP which is a test result of the wafer to be processed;

a first (b) step of acquiring polishing condition data, film thickness data before CMP, and film thickness data after CMP of a test wafer in a monitor process for confirming performance of equipment used for the polishing of a wafer to be processed, or acquiring polishing condition data, film thickness data before CMP, and film thickness data after CMP of a wafer in the previous process before the polishing; and a first (c) step of selecting a within-wafer distribution model of a removal rate which represent a distribution of the removal rate within the wafer, a within-wafer distribution model of a film thickness before/after CMP which is a model representing the film thickness before/after CMP, and a within-wafer distribution model of a polishing process which is a model representing the passage of time in the polishing, said second step includes:

a second (a) step of obtaining a within-wafer distribution of a film thickness before/after CMP by determining a parameter of the within-wafer distribution model before/after CMP selected in said first (c) step based on the data acquired in said first (b) step; and a second (b) step of obtaining a within-wafer distribution of a removal rate by determining a parameter of the within-wafer distribution model of the removal rate acquired in said first (c) step based on the within-wafer distribution of the film thickness before/after CMP obtained in said second (a) step, the data acquired in said first (b) step, and the within-wafer distribution model of the polishing process selected in said first (c) step, and said third step includes:

a third (a) step of selecting a within-wafer distribution model of a polishing process corresponding to the within-wafer distribution model of the film thickness after CMP for estimating a film thickness after CMP of the wafer in the process;

a third (b) step of obtaining a within-wafer distribution of a film thickness before CMP by determining a parameter of a within-wafer distribution model of a film thickness before CMP of the wafer in the process based on the data acquired in said first (a) step; and a third (c) step of determining a polishing condition with the restriction that the film thickness at each position in the within-wafer distribution of the film thickness after CMP satisfies the control limit by estimating a thickness in the polishing process from passage of time based on the within-wafer distribution of the removal rate obtained in said second (b) step, the within-wafer distribution model of the polishing process selected in said third (a) step, and the within-wafer distribution of the film thickness before CMP obtained in said third (b) step.

4. The method of polishing a wafer according to claim 3, wherein the within-wafer distribution model of the removal rate and the within-wafer distribution model of the film thickness before/after CMP selected in said first (c) step are set as parametric models in the coordinate system with respect to a line segment and a curved line segment in a radial section in a radial direction or a plane surface and a curved surface in an arbitrary area on the wafer, said second (a) step determines a parameter of the model in the radial section or a region based on the data before/after CMP at the coordinate of the measurement site and the adjacent information in the radial section or the region, said second (b) step determines a parameter of the within-wafer distribution model of the removal rate by estimating the film thickness before/after CMP, and said third (c) step determines the polishing condition by estimating the film thickness before CMP and the removal rate at a position corresponding to the distribution of the film thickness model after CMP based on the within-wafer distribution model.

5. The method of polishing a wafer according to claim 3, wherein the within-wafer distribution model of the removal rate selected in said first (c) step includes as parameters a size based on the equipment configuration, a setting value to the equipment, a type of the polishing process, a type of the wafer or an LSI chip, a type of the polishing process, and physical characteristics of the wafer or the LSI chip, said within-wafer distribution model of the polishing process selected in said third (a) step includes as parameters a size based on the equipment configuration, a setting value to the equipment, a type of the polishing process, a type of the wafer or an LSI chip, a type of the polishing process, and physical characteristics of the wafer or the LSI chip, and said third (c) step determines the polishing conditions on the basis of the within-wafer distribution of the removal rate and the within-wafer distribution of the polishing process by estimating an ideal within-wafer distribution of the removal rate and the polishing process so that the within-wafer distribution of the film thickness after CMP becomes uniform based on the within-wafer distribution of the film thickness before CMP.

6. The method of polishing a wafer according to claim 3, wherein said restriction of the film thickness after CMP for the control limit in said third (c) step is a restriction that a difference between the upper control limit and the maximum estimation value of the within-wafer distribution of the film thickness after CMP is equal to a difference between the minimum estimation value of the within-wafer distribution of the film thickness after CMP and the lower control limit.

7. The method of polishing a wafer according to claim 3, wherein, in the case where a film with a step height on a surface thereof is formed through the process flow of metal deposition, photography, metal etching, and an insulating film deposition as a previous process of the polishing, the within-wafer distribution model of the polishing process selected in said first (c) step has, as parameters, an amount obtained by subtracting a polishing amount in the case of polishing a planar insulating film in the same time from a polishing amount obtained from a difference in the film thickness before/after CMP at the thickness measurement site which is determined by polishing the surface step height, and a ratio of a removal rate which changes depending on a polishing condition with respect to the within-wafer distribution of the reference removal rate and the film type.

8. The method of polishing a wafer according to claim 3, further comprising:

a fourth step of acquiring polishing condition data, film thickness data before CMP, and film thickness data after CMP with respect to a plurality of processed wafers;

a fifth step of estimating a variation between wafers directly based on the film thickness data after CMP acquired in said fourth step or estimating the variation in the film thickness after CMP between wafers based on the variation between wafers estimated from the film thickness data before CMP and the variation in the removal rate between wafer processes estimated from the polishing condition data, the film thickness data before CMP and the film thickness data after CMP;

a sixth step of determining whether or not the process is started based on the probability of deviation from the control limit by comparing the margin of the film thickness after CMP for the upper control limit and the lower control limit determined in said third step with the variation in the film thickness after CMP between wafers estimated in said fifth step; and a seventh step of performing a process for determining a condition for adjusting the parameters of each model when it is determined that the process cannot be started in said sixth step.

* * * * *